US011969062B2

(12) United States Patent
Kane

(10) Patent No.: US 11,969,062 B2
(45) **Date of Patent: *Apr. 30, 2024**

(54) JEWELRY CHAIN WITH MOVABLE ALPHANUMERIC CHARACTER LINKS

(71) Applicant: K KANE, LLC, New York, NY (US)

(72) Inventor: Katherine Kane, New York, NY (US)

(73) Assignee: K Kane, LLC, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/185,640

(22) Filed: Mar. 17, 2023

(65) Prior Publication Data

US 2023/0218051 A1 Jul. 13, 2023

Related U.S. Application Data

(63) Continuation of application No. 16/035,012, filed on Jul. 13, 2018, now Pat. No. 11,641,913.

(51) Int. Cl.

| | |
|---|---|
| ***A44C 5/10*** | (2006.01) |
| ***A44C 7/00*** | (2006.01) |
| ***A44C 11/00*** | (2006.01) |
| ***A44C 13/00*** | (2006.01) |
| ***A44C 15/00*** | (2006.01) |

(52) U.S. Cl.

CPC ..... *A44C 11/00* (2013.01); *A44C 5/105* (2013.01); *A44C 7/002* (2013.01); *A44C 13/00* (2013.01); *A44C 15/005* (2013.01)

(58) Field of Classification Search

CPC ..... A44C 15/005; A44C 13/00; A44C 7/002; A44C 11/00; A44C 5/105; A44C 5/02; A44C 5/10

See application file for complete search history.

(56) References Cited

U.S. PATENT DOCUMENTS

| | | | | |
|---|---|---|---|---|
| 758,848 | A * | 5/1904 | Pejchar | A44C 7/00 63/29.1 |
| 1,069,581 | A * | 8/1913 | Rosenberg | A44C 5/107 59/82 |
| D97,222 | S | 10/1935 | Chernow | |
| 2,052,381 | A | 8/1936 | Chernow | |
| 2,224,721 | A | 12/1940 | Chernow | |

(Continued)

OTHER PUBLICATIONS

Sideways Initial Necklace, htlps://www.etsy.com/listing/521630191/sideways-initial-necklace-initial?ga_order=most_relevant&ga_search_type=all&ga_view_type=gallery&ga_search_query=hollowletters&ref32 sc_gallery-1-5&plkey=cd589b38a657216415bc6585c1f26a3fcea198c5:521630191 (May 2018).

(Continued)

*Primary Examiner* — Emily M Morgan
(74) *Attorney, Agent, or Firm* — Allan A. Fanucci

(57) ABSTRACT

A jewelry chain having a plurality of links including a plurality of connecting links and one or a plurality of decorative links. Each decorative link comprises an outline of an alphanumeric character and becomes part of the chain by connection from at least two connecting links. The connecting links can easily pass through open sections of the alphanumeric character outline to allow rotation and sliding movement in at least two different directions so that the alphanumeric character can provide different appearances when the jewelry chain is worn. The chain can form or be incorporated in necklaces, bracelets or earrings.

20 Claims, 3 Drawing Sheets

(56) References Cited

U.S. PATENT DOCUMENTS

| | | | | |
|---|---|---|---|---|
| D143,748 | S | 2/1946 | Palliser | |
| D179,380 | S | 12/1956 | Dana | |
| D179,381 | S | 12/1956 | Dana | |
| D313,571 | S | 1/1991 | Brom | |
| D354,700 | S | 1/1995 | Fraimovici et al. | |
| 6,401,488 | B1 | 6/2002 | Cousin et al. | |
| D493,118 | S | 7/2004 | Neri | |
| D526,234 | S | 8/2006 | Dolce et al. | |
| D706,666 | S * | 6/2014 | Zeuner | D11/7 |
| D711,763 | S * | 8/2014 | Zeuner | D11/7 |
| D719,047 | S | 12/2014 | Traglio | |
| 9,408,442 | B1 | 8/2016 | Terry et al. | |
| 11,641,913 | B2 * | 5/2023 | Kane | A44C 15/005 63/4 |
| 2004/0244199 | A1 | 12/2004 | Kasten | |
| 2005/0189084 | A1 * | 9/2005 | Bitton | A63H 33/32 164/109 |
| 2010/0281918 | A1 | 11/2010 | Colpo | |
| 2019/0208872 | A1 | 7/2019 | Kadar | |

OTHER PUBLICATIONS

Hollow Out Letter Charms, https://www.etsy.com/listing/559322066/add-a-letter-plateantique-silver-letter?ga_order=most_relevant&ga_search_type=all&ga_view_type=gallery&ga_search_query=hollowletters&ref=sr_gallery-2-17&more_colors=1 (May 2018).
Round Hollow Letter Charms, https://www.etsy.com/listing/573311674/titanium-steel-hollow-letter-round?ga_order=most_relevant&ga_search_type=all&ga_view_type=gallery&ga_search_query=hollowletters&ref=sr_gallery-1-14 (May 2018).
K Kane website, https://k-kane.com/ (May 2018).
Sassy A-Z Letter Links (Year: 2015).
STIC search report (Year: 2019).
Delish Beads, "Cute Shapes Plastic Chain Links," Aug. 4, 2016; https://www.delishbeads.com/products/cute-shapes-plastic-chain-links-20mm-bright-colorful-star-heart-and-oval-shape-pearly-plastic-or-acrylic-chain-links-100-pc-set (Year: 2016).
Stefanie Girard, "11 ways to make rain chains—1 with cookie cutters," May 11, 2015, wayback machine capture on May 13, 2015 (Year: 2015).
U.S. Appl. No. 16/035,012, Non-Final Rejection, dated Jun. 24, 2019.
U.S. Appl. No. 16/035,012, Final Rejection, dated Nov. 19, 2019.
U.S. Appl. No. 16/035,012, Advisory Action, dated Mar. 30, 2020.
U.S. Appl. No. 16/035,012, Non-Final Rejection, dated May 4, 2020.
U.S. Appl. No. 16/035,012, Final Rejection, dated Oct. 19, 2020.
U.S. Appl. No. 16/035,012, Advisory Action, dated Jan. 8, 2021.
U.S. Appl. No. 16/035,012, Non-Final Rejection, dated Jan. 29, 2021.
U.S. Appl. No. 16/035,012, Final Rejection, dated Aug. 9, 2021.
U.S. Appl. No. 16/035,012, Advisory Action, dated Oct. 20, 2021.
U.S. Appl. No. 16/035,012, Non-Final Rejection, dated Nov. 19, 2021.
U.S. Appl. No. 16/035,012, Final Rejection, dated Feb. 28, 2022.
U.S. Appl. No. 16/035,012, Advisory Action, dated Apr. 28, 2022.
U.S. Appl. No. 16/035,012, Non-Final Rejection, dated Jul. 27, 2022.
U.S. Appl. No. 16/035,012, Final Rejection, dated Oct. 11, 2022.
U.S. Appl. No. 16/035,012, Pre-Brief Appeal Conference Decision, dated Feb. 6, 2023.
U.S. Appl. No. 16/035,012, Notice of Allowance, dated Feb. 17, 2023.

* cited by examiner

JEWELRY CHAIN WITH MOVABLE ALPHANUMERIC CHARACTER LINKS

CROSS-REFERENCE TO RELATED APPLICATIONS

This application is a continuation of application Ser. No. 16/035,012 filed Jul. 13, 2018, now U.S. Pat. No. 11,641,913 B2 issued May 9, 2023.

BACKGROUND

The invention relates to a jewelry chain that has a plurality of connecting links and one or more hollow decorative links that become part of the chain by connection from at least two connecting links so that the connecting links pass through open sections of the hollow alphanumeric character outline and allow rotation and sliding movement of the alphanumeric character when the jewelry chain is worn.

It is conventional to provide a number of different chain elements in a jewelry chain. Often, the connecting links of the chain are simply connected together to form a continuous loop that can be used as a necklace or bracelet. There are many different styles and thicknesses of the connecting links to provide different appearances of the chain.

Often, however, the chain is embellished with charms or other decorative items that are fixed to the chain, generally. Often, these decorative items have one or more fixed loops or other types of connection links that are connected directly to the chain and suspends the decorative element in a desired position. See e.g., the Hollow out Letter Charms disclosed at https://www.etsy.com/listing/559322066/add-a-letter-plate-antique-silver-letter?ga_order=most_relevant&ga_search_type=all&ga_view_type=gallery&ga_search_query=hollow letters&ref=sr_gallery-2-17&more_colors=1 or the Round hollow letter charms disclosed at https://www.etsy.com/listing/573311674/titanium-steel-hollow-letter-round?ga_order=most_relevant&ga_search_type=all&ga_view_type=gallery&ga_search_query=hollow letters&ref=sr_gallery-1-14. When such letters are used, the letters are often selected to spell a name when suspended on the chain.

More recently, certain jewelry chains have considered attempting to incorporate letters into the chain itself. In one arrangement, the letters have multiple openings to receive connecting elements. See, e.g., the Sideways Initial Necklace disclosed at https://www.etsy.com/listing/521630191/sideways-initial-necklace-initial?ga_order=most_relevant&ga_search_type=all&ga_view_type=gallery&ga_search_query=hollow letters&ref=sc_gallery-1-5&plkey=cd589b38a657216415bc6585c1f26a3fcea198c5:521630191.

Also, U.S. Pat. No. 6,401,488 discloses includes a novel pop bead construction wherein each pop bead includes a spherical body, and an elongated, flexible neck formed on the spherical body and extending radially therefrom, with a ball is formed on a distal free end of the elongated, flexible neck. A socket is formed in the spherical body on a surface opposite the elongated, flexible neck and includes a cavity and an opening into the cavity which can receive the ball of another bead. FIGS. 8 and 9 illustrate the use of the pop bead construction to connect letters together e.g., to form the name of the wearer.

Despite these prior developments, it has been found that the letters are relatively fixed when added to the chain. Accordingly, it would be desirable to provide letters in a chain that are able to move in a manner that reflects the movement of the chain links themselves. This is now provided by the present invention.

SUMMARY OF THE INVENTION

The invention now provides a jewelry chain comprising a plurality of links including a plurality of connecting links and one or a plurality of decorative links. Each decorative link comprises an outline of an alphanumeric character and becomes part of the chain by connection from at least two connecting links. The connecting links can easily pass through open sections of the alphanumeric character outline to allow rotation and sliding movement in at least two different directions so that the alphanumeric character can provide different appearances when the jewelry chain is worn.

The connecting links are round, oval, or polygonal, preferably rectangular, and each alphanumeric character is connected to the chain only by two connecting links. For some designs, three or more connecting links can be provided but these can inhibit movement of the character so for that reason, they are not preferred.

Certain alphanumeric characters have an outline of a continuous outline member and have no internal supports. This would include the letters C, E, F, G, H, I, J, K, L, M, N, S, T, U, V, W, X, Y, Z or the numbers 1, 2, 3, 5, 7 or 0. Certain other alphanumeric characters have an outline made of a plurality of outline members. This would include the letters A, B, D, O, P, Q, R or the numbers 4, 6, 8 or 9.

The jewelry chain preferably includes a plurality of alphanumeric characters which are letters, a plurality of alphanumeric characters which are numbers, or the combination of one or more letters and one or more numbers. Preferably, the plurality of alphanumeric characters spell out one or more names, nicknames, initials, e-mail address, Instagram handle, Twitter address, slogan, statement, trademark, zip code, area code, or a country or abbreviation thereof, and the jewelry chain is configured as a bracelet, necklace or earrings. When the jewelry chain is configured as a bracelet, necklace, a clasp for closure can be included. When an earring is provided, the jewelry chain is suspended from one of the alphanumeric characters that includes a post for insertion into a hole in the wearer's ear lobe. The first or top alphanumeric character generally includes the post and the alphanumeric character furthest from the post has only one connecting link.

BRIEF DESCRIPTION OF THE DRAWINGS

Preferred features of the invention are now described in the following detailed description when read in conjunction with the appended drawing figures, wherein.

DETAILED DESCRIPTION OF THE INVENTION

Figure 1:
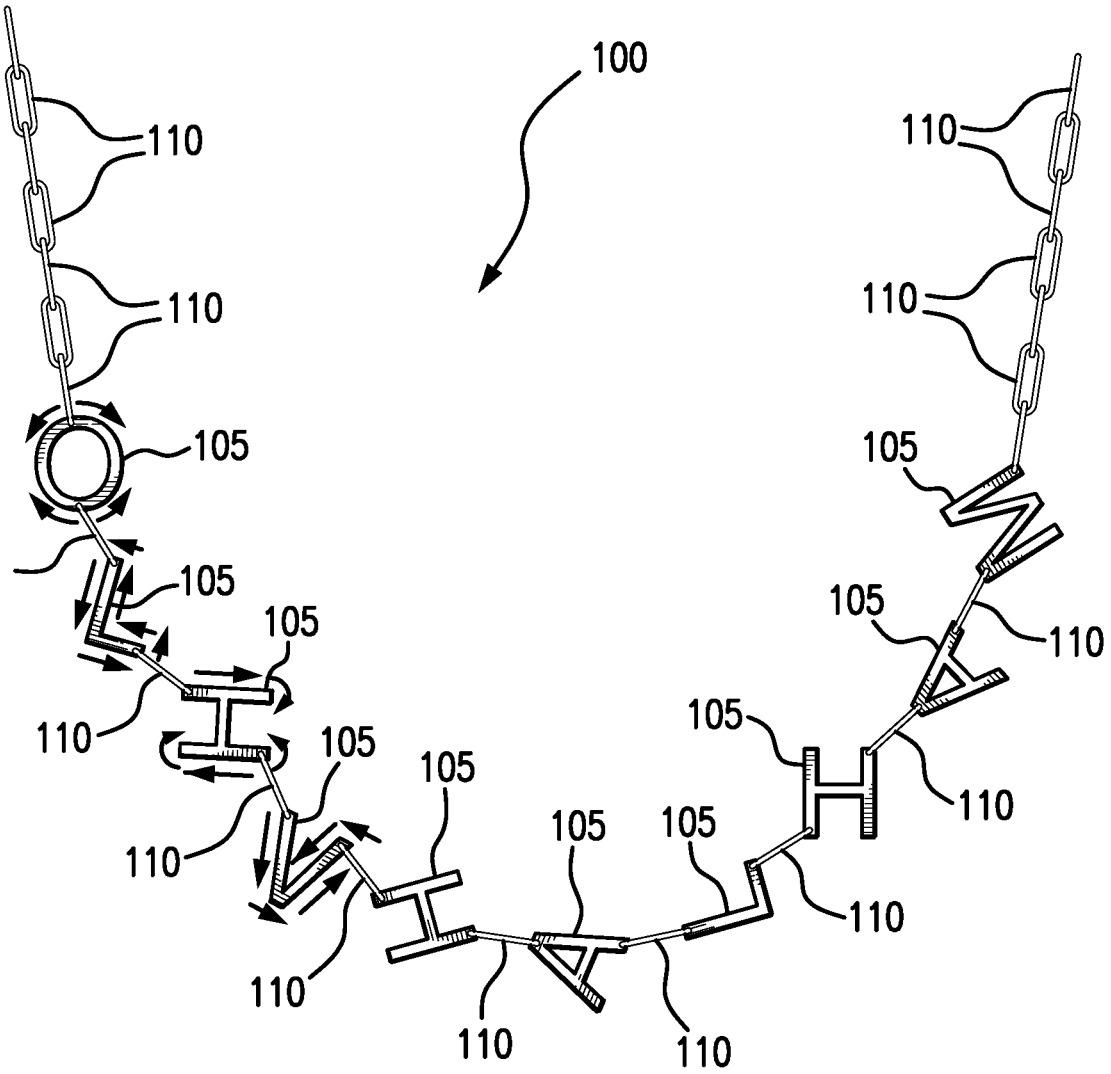
FIG. 1 is an illustration of a jewelry chain that includes connecting links and decorative hollow letters according to the present invention.

The invention now provides a jewelry chain having one or a plurality of connecting links, wherein each connecting link is a closed loop made from a wire or thin strip of a precious metal; along with one or a plurality of decorative links, each of an open alphanumeric character of a letter or number having an outline member made from a continuous wire or continuous thin strip of a precious metal that surrounds at least one open section therein. Each open channel section is elongated, has a width and extends completely within the outline member such that the outline member and open section(s) therein solely define the shape of the open alphanumeric character. Also, the at least one connecting link connects to the at least one decorative link by extending into the open section(s) and around the wire or strip of precious metal, such that the at least one connecting link can travel along and within an open section of the outline member in the elongated open section(s), allowing the decorative link to assume multiple orientations with respect to the wearer of the jewelry chain.

Connecting links for jewelry chains are typically made from a precious metal member, wherein the precious metal is typically gold, silver, platinum or palladium. The member is in the form of a wire or thin strip that is configured to have an open shape which may be circular, oval, or polygonal. The shape is generally made by bending the member and having one end meet the other to form a closed structure. When polygonal shapes are used, square, triangular or rectangular shapes are preferred, often with the corners smoothed. The shapes can also be bent or twisted. For example, any one of Anchor Chain, Cable of Link Chain, Crinkle Chain, Curb Chain, Elongated Cable Chain, Figaro Chain, Flat Link Cable Chain, Long and Short Chain, Peanut Chain, Ring and Connector Chain, or Round Link Chain, each as described in Jewellery Chain Glossary A to Z, is acceptable (see https://www.bigbeadlittlebead.com/guides_and_information/jewellery_chain_glossary.php). Oval or rectangular connecting links (with or without rounded corners) are preferred, as is Elongated Cable Chain, Long and Short Chain or Ring and Connector Chain. Links of rounded corner rectangles that have at least one third to the about the same length of the alphanumeric characters are preferred with rounded corner rectangles that have at least one half to about three quarters the length of the alphanumeric characters are most preferred. The one-third to one half size is desirable for a delicate yet highly aesthetic appearance. And when a Long and Short Chain or a Ring and Connector Chain is used for connector links, the longer links of those chains are connected to the alphanumeric characters.

When these open chain links are connected, they can rotate clockwise or counter clockwise through the preceding and following link. According to the present invention, the decorative alphanumeric links also can rotate clockwise and counter clockwise through the preceding and following link which connects the character into and as part of the chain. This occurs because the chain links slide through the open section of the characters, in both clockwise and counter-clockwise directions, thus allowing the character to rotate or take different positions on the chain with interesting visual appearances as a result.

The width between the exterior and interior members of the characters is about 0.025" but they can be between 0.02 and 0.1" depending upon the desired feminine or masculine effect, or the degree of precious metal value desired based on thickness of the member. The dimensions of the depth or thickness of the members would be about the same as those of the width. The preferred members are wire have a round cross-section although wire or strip having an oval or polygonal cross-section can also be used. Any polygonal shape would preferably have rounded corners.

Additionally, the width of the connecting chain link member is about 0.016" but can increase proportionally to the width of the characters for the same purpose of providing more masculine or feminine options or higher end precious metal value. The depth of the connecting chain link member would be essentially the same as the width.

Preferably, the dimensions of the members forming the alphanumeric characters would be close to or essentially the same as those of the connecting chain links because the letters are incorporated into the chain in the same manner as the connecting links themselves. The same is true for the overall width of the alphanumeric characters and connecting links. This enables the characters to rotate either clockwise or counter clockwise or back and for the between both, with the result that the alphanumeric character sits at a variety of different angles on the chain as the wearer moves about, thus presenting unusual and desirable visual effects for the jewelry chain whether it is used as a necklace, bracelet, or ankle or belly chain. Generally, for such items, the alphanumeric character would be joined to the chain by two connective links, so that the alphanumeric character can be supported therebetween. The ends of the chain can be joined together by connective links or by a conventional clasp mechanism.

Another embodiment of the invention is to have a plurality (i.e., more than one) of the alphanumeric characters joined to an earring post, with the characters hanging down from the post towards the wearer's shoulders. In this embodiment, the lower end of the chain is free and if desired can terminate at the last alphanumeric character. As in the other embodiments, the alphanumeric characters (except for the last one) would have two connecting elements.

The invention will now be illustrated by a necklace that contains the inventive decorative hollow alphanumeric characters in the form of letters.

FIG. 1 is an illustration of a chain 100 that includes decorative letters 105 that spell the names OLIVIA LIAM based on the selection of the appropriate letters and presentation of those letters in the order necessary to spell the name. The letters 105 are made in outline with either a completely open internal structure or a partially open internal structure or open section. The outline of the alphanumeric character is made from one or more outline members. For example, the letters C, E, F, G, H, I, J, K, L, M, N, S, T, U, V, W, X, Y, Z and the numbers 1, 2, 3, 5, 7, or 0 are made with a single precious metal wire that forms an outline of the letter or number. The letters A, B, D, O, P, Q, R or the numbers 4, 6, 8 or 9 are made with multiple outline members or segments which are joined together to form the letter or number. Each outline member is shown as a black line boundary surrounding an elongated open section of uniform width. The outline member is made from a wire or thin strip of precious metal. The white areas of each letter or number constitute the elongated open sections which are located within the walls of the outline members or segments. Both the wire and/or thin strips of the decorative links and the connecting links can be made of precious metal such as gold, silver, platinum, palladium, or one of their alloys.

The chain includes a number of connecting links 110 each of which are rectangular in configuration with rounded edges to avoid catching on clothes and to facilitate smooth movement in the open spaces of the decorative letters. As shown each letter 105 includes two connecting links 110 which are positioned on each end of the letter when the chain is held vertically. As noted above, however, the connecting chain links can move anywhere within the open spaces of the outlined letters 105 to effectively allow the letter to rotate, twist, spin or otherwise take different positions that provide an interesting appearance that varies as the person moves. FIG. 1 illustrates how the various letters 105 which are joined by the connecting links 110 can move, with arrows shown around the letters O, L, I and V.

The particular names shown in FIG. 1 are the actual names of the children of the woman for whom the necklace was made. Of course, the selection of the characters can be personal to the user, and can include the person's name, nickname or initials. It also could include the name of the wearer along with his or her children, parents, significant other, again with the first names, nicknames or initials. The necklace could include a short phrase, slogan or trademark, zodiac sign, or even an advertisement (i.e., DRINK COKE) or statement (i.e., SAVE THE WHALES). If desired, the alphanumeric characters could provide an e-mail or twitter address, or a telephone number, zip code, area code or country code or abbreviation. Accordingly, the alphanumeric characters can include other characters, such as a plus sign, ampersand, or other special character such as @, #, $, %, ! or ?. Also, when letters are used, upper case, lower case, script or combinations thereof can be used. Alphanumeric characters in script form would typically have a non-uniform opening width which conforms to the script. Thus, what can be presented on the necklace or other jewelry chain article is limited only by the imagination and desire of the person who is to wear the article.

Figure 2:
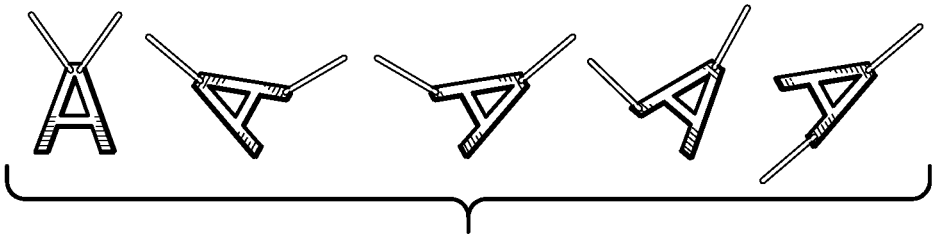
FIG. 2 is an illustration of some of the ways that the decorative hollow letter could be positioned in the chain as they rotate on the connecting links.

FIG. 2 is an illustration of just some of the ways the letter A could be attached into the chain depending upon where the connecting links reside in the open space within the outline of the letter. As shown the crossbar in the A is made by a second bent wire segment such that connection in that area would be too restrictive. Thus, the connectors join into the open area of the upside-down V outline that forms part of the shape of the letter A. As shown, the letter A is able to rotate or move to provide a nearly limitless number of positions when joined in the chain to provide new and different appearances when the chain is viewed by an observer. The same is true of the other letters and numbers, with the ones having the completely open outline have more degrees of freedom that those that have second connecting structures to form the outline of the letter.

Figures 3A, 3B:
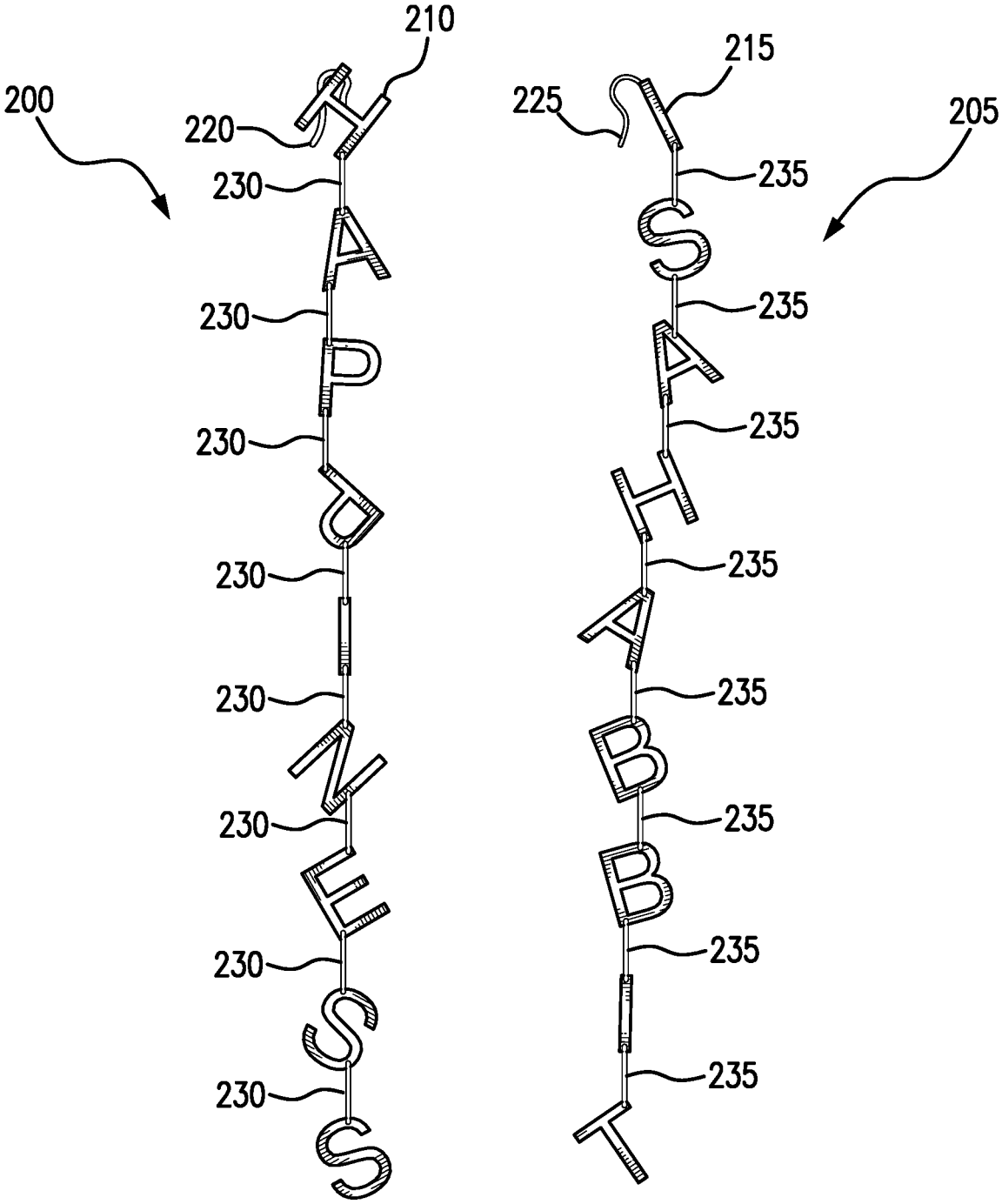
FIGS. 3A and 3B are illustrations of earrings according to the present invention.

FIGS. 3A and 3B illustrate earrings 200, 205 according to the present invention. In each case, the top letter 210, 215 includes a post for inserted an opening in the wearer's ear. FIG. 3A illustrates the word "HAPPINESS" with the first letter (H) including the post 220 and with the other letters joined by connecting links 230 which are the same as those shown in FIGS. 1 and 2. Also, FIG. 3B illustrates the words "IS A HABIT" with the first letter (I) including the post 225 and with the other letters joined by connecting links 235. The letters can move as worn providing an interesting look that changes as the person walks by. And when an earring contains only one alphanumeric character, the alphanumeric character would be joined to the chain by one connective link.

Figure 4:
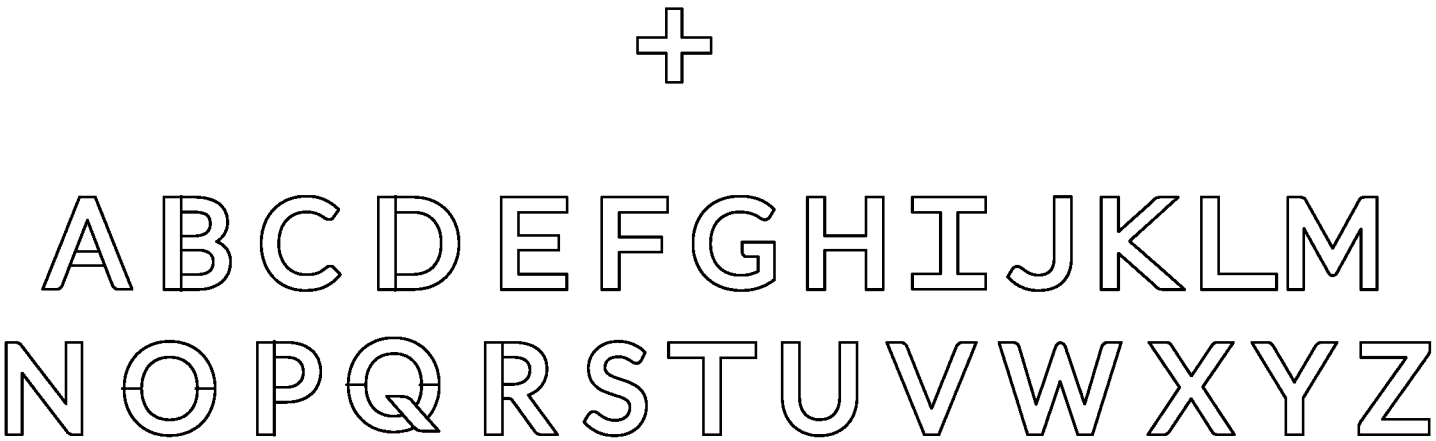
FIG. 4 illustrates a preferred alphabet font for the decorative hollow letters.

A preferred font for the letters including reinforcing structural elements for the letters A, B, D, O, P, Q, and R is illustrated in FIG. 4. With these letters, numbers and connectors, a wide variety of combinations are entirely possible. And although the outline of the letters and numbers are shown in a block style with a uniform width opening, different font outlines or even script configurations can be used according to the teachings of the invention, with the letters or numbers simply being made in an outline with the connector links joining the outline such that the letter or number acts as a link in the chain. Additionally, other conventionally suspended charms or letters can be added to provide further interesting aesthetics to the article.

Therefore, in sum, it is to be realized that the optimum dimensional relationships for the parts of the invention can include variations and tolerances in size, materials, shape, form, function and use are deemed readily apparent and obvious to the skilled artisan, and all equivalent relationships to those illustrated in the drawings and described in the specification are intended to be encompassed by the claims appended hereto.

Unless defined otherwise, all technical and scientific terms used herein have same meaning as commonly understood by one of ordinary skill in the art to which this invention belongs. Also, as used herein and in the appended claims, the singular form "a", "and", and "the" include plural referents unless the context clearly dictates otherwise. All technical and scientific terms used herein have the same meaning.

The foregoing detailed description is considered as illustrative only of the principles of the invention. Further, since numerous modifications and changes will readily be apparent to those having ordinary skill in the art, it is not desired to limit the invention to the exact constructions demonstrated. Accordingly, all suitable modifications and equivalents may be resorted to falling within the scope of the invention.

What is claimed is:

1. A jewelry chain comprising a plurality of links including one or a plurality of connecting links and one or a plurality of decorative links with each link being made of a precious metal comprising gold, silver, platinum, palladium, or one of their alloys, wherein each of the decorative links comprises an alphanumeric character made of at least one outline member which defines an elongated open section therein, with the outline member(s) forming an outermost boundary of the alphanumeric character, wherein the decorative link becomes part of the jewelry chain by connection from at least one of the connecting links, wherein each connecting link passes through an open section of one outline member, wherein the outline member(s) and open section(s) solely define the alphanumeric character with each connecting link able to slide along the elongated open section of the outline member of the decorative link to which it is connected, whereby the outline member and connecting link are configured to allow the decorative link to sit at a variety of different angles on the chain as a wearer of the jewelry chain moves about.

2. The jewelry chain of claim 1 wherein the connecting links are round, oval, rectangular and each alphanumeric character is connected to the chain only by two connecting links.

3. A jewelry chain comprising a plurality of links including one or a plurality of connecting links and one or a plurality of decorative links with each link being made of a precious metal comprising gold, silver, platinum, palladium, or one of their alloys, wherein each of the decorative links comprises an alphanumeric character made of at least one outline member which defines an elongated open section therein, with the outline member(s) forming an outermost boundary of the alphanumeric character, wherein the decorative link becomes part of the jewelry chain by connection from at least one of the connecting links, wherein each connecting link passes through an open section of one outline member, wherein the outline member(s) and open section(s) solely define the alphanumeric character with each connecting link able to slide along the elongated open section of the outline member of the decorative link to which it is connected, whereby the outline member and connecting link are configured to allow the decorative link to sit at a variety of different angles on the chain as a wearer of the jewelry chain moves about, wherein the alphanumeric character is made of one continuous outline member and has no internal supports.

4. The jewelry chain of claim 3 wherein the alphanumeric character is the letter C, E, F, G, H, I, J, K, L, M, N, S, T, U, V, W, X, Y, Z or the numbers 1, 2, 3, 5, 7 or 0.

5. The jewelry chain of claim 1 wherein the alphanumeric character is made of two or three outline members.

6. The jewelry chain of claim 5 wherein the alphanumeric character is the letter A, B, D, O, P, Q, R or the numbers 4, 6, 8 or 9.

7. The jewelry chain of claim 1 which includes a plurality of alphanumeric characters which are letters.

8. The jewelry chain of claim 1 which includes a plurality of alphanumeric characters which are numbers.

9. The jewelry chain of claim 1 which includes a plurality of alphanumeric characters one or more of which are letters and one or more of which are numbers.

10. The jewelry chain of claim 1 which includes a plurality of alphanumeric characters that spell out one or more names, nicknames, initials, e-mail address, twitter address, slogan, statement, trademark, zip code, area code, or a country or abbreviation thereof.

11. A jewelry chain configured as a bracelet, necklace or an earring, the jewelry chain comprising a plurality of links including one or a plurality of connecting links and one or a plurality of decorative links with each link being made of a precious metal comprising gold, silver, platinum, palladium, or one of their alloys, wherein each of the decorative links comprises an alphanumeric character made of at least one outline member which defines an elongated open section therein, with the outline member(s) forming an outermost boundary of the alphanumeric character, wherein the decorative link becomes part of the jewelry chain by connection from at least one of the connecting links, wherein each connecting link passes through an open section of one outline member, wherein the outline member(s) and open section(s) solely define the alphanumeric character with each connecting link able to slide along the elongated open section of the outline member of the decorative link to which it is connected, whereby the outline member and connecting link are configured to allow the decorative link to sit at a variety of different angles on the chain as a wearer of the jewelry chain moves about.

12. The jewelry chain of claim 11, which includes a clasp for closure.

13. The jewelry chain of claim 11, which is configured as an earring with one of the alphanumeric characters including a post.

14. The jewelry chain of claim 13 wherein the first alphanumeric character includes the post.

15. The jewelry chain of claim 13 wherein the alphanumeric character furthest from the post has only one connecting link.

16. The jewelry chain of claim 11, which includes a plurality of alphanumeric characters which are letters.

17. The jewelry chain of claim 11, which includes a plurality of alphanumeric characters which are numbers.

18. The jewelry chain of claim 11, wherein the plurality of decorative links include one or more alphanumeric characters which are letters and one or more alphanumeric characters which are numbers.

19. The jewelry chain of claim 1, wherein the elongated open sections are of uniform width.

20. The jewelry chain of claim 11, wherein the elongated open sections are of uniform width.

* * * * *